United States Patent [19]

Arenzana

[11] Patent Number: 4,911,584

[45] Date of Patent: Mar. 27, 1990

[54] METHOD FOR SOIL INJECTION

[76] Inventor: Luis Arenzana, 2610 Central St., Evanston, Ill. 60201

[21] Appl. No.: 230,446

[22] Filed: Aug. 9, 1988

[51] Int. Cl.[4] ..... E02D 3/12

[52] U.S. Cl. ..... 405/264; 405/266; 405/269

[58] Field of Search ..... 405/263, 266, 267, 269, 405/264; 106/900

[56] References Cited

U.S. PATENT DOCUMENTS 1,929,215 10/1933 Poulter .
2,233,872 3/1941 Proctor .
4,540,316 9/1985 Takahashi ..... 405/264

OTHER PUBLICATIONS

Civil Engineering, vol. 58, No. 1, Jan. 1988, Authored by A. Brand, P. Blakita, W. Clarke.
Product Bulletin from Geochemical Corp. of N.J.
Paper Presented at 23rd Int'l. Cement Seminar in Atlanta, GA on 12/6-9/87.
Doctoral Dissertation, "An Experimental Investigation of the Properties & Behavior of Dilute Microfine Cement Grout" by invention dated 8/87 submitted to Northwestern University Graduate School of Engineering, Cataloged in Northwestern's Library on Sep. 22, 1987.

*Primary Examiner*—David H. Corbin
*Attorney, Agent, or Firm*—Allegretti & Witcoff, Ltd.

[57] ABSTRACT

A method of grouting fine-grained soil mediums is presented that uses an injection process operating at low constant pressure. The process provides for deep penetration of fine sands by injecting a dilute suspension grout composition comprising water and cementatious particles. The grout composition is characterized by a water to cementatious particles ratio of at least 4:1 by weight.

9 Claims, 1 Drawing Sheet

METHOD FOR SOIL INJECTION

BACKGROUND

A. Field of Invention

This invention relates to an improved method of grouting soil mediums. More specifically this invention is directed to the grouting of fined grained soil medium using a dilute suspension of cementatious particles in water.

B. Prior Art

Grouting has been used for more than a century to improve the engineering properties of soils. Grouts can be classified on the basis of their principle ingredients into two categories, suspension grouts and chemical grouts. Suspension grouts include cement and bentonite, whereas chemial grouts include sodium silicate, acrylate, and acrylamide. Suspension grouting has been traditionally limited to course sands and larger grained soil mediums. The range of soils that can be successfully grouted is limited by the grain size of the materials utilized to prepare the grout.

Chemical grouts are commonly prepared with organic monomers diluted with water. By adding a catalyst, such as an acid agent or a polyvalent salt, the aqueous solution of monomer is transformed into a gel that sets over a period of time to a solid mass. In general, the viscosity of chemical grouts is low and does not change before mass polymerization occurs. This allows chemical grouts to be injected into fine sands and/or silty soils. However, various components of chemical grouts, such as those used with acrylamide and polyurethane grouts, are highly toxic and are known to contaminate ground water.

With the drawbacks associated with chemical grouting and the limitations on the particle size of conventional suspension grouting materials there has been an effort to obtain suspension type grouts with the appropriate gradation of suspended solids to penetrate into fine sand formations and to develop guidelines for the use of such grouts in construction. To this end the use of microfine cement has been suggested. Microfine cement is a cementatious grouting material composed of ultrafine particles that may be used for stablizing all types of earth foundations. A water to microfine cement ratio of up to 3:1 has been recommended for grouting of fine grained sands.

The art is replete with a wide variety of materials and processes to stabilize soils, or improve subgrades in the subsurface layers adjacent to the surface of the earth for a variety of purposes. For example, U.S. Pat. No. 1,929,215 (Poulter) discloses a method of raising and backfilling pavement. The mixture employed comprises soil, cement and water, with a water to cement ratio of 12:1. This mixture is then pumped into void spaces under rigid type pavements to correct settlement or deficiencies in subgrades. High pumping pressure is required to achieve the hydrostatic power necessary to lift the pavement being raised. A means for solidifying underground structures using a grout that penetrates a great distance is disclosed in U.S. Pat. No. 2,233,872 (Procter). The grout composition is composed of cement, water and a gel. No setting of the grout nor a change in hardness of the soil, is observed when using a grout mixture having a water:cement ratio greater than 3.5. further, a pressure of 30 to 50 psi is required to inject grout mixtures of the Procter invention. Likewise, U.S. Pat. No. 4,540,316, (Takahashi) teaches an impregnation method which uses a mixture of cement, bentonite, water, and a naturally occurring waste material in the proportions of 1.0:1.0–3.5:0.5–2.0.

In summary, the art has recognized various grouting techniques, including the use of microfine cement for penetrating soil medium having fine grained particles. However, the art has not recognized the use of a dilute suspension type grouting method that operates at low a constant pressure and can penetrate fine grained soil mediums without causing soil fracture.

SUMMARY OF THE INVENTION

It is an object of this invention to provide a grouting technique for increasing the strength and reducing the permeability of soil.

Another object of this invention is to provide a grouting technique that is not dependent on the water to cement ratio and can operate at a constant low pressure.

Yet another object of this invention is to provide a grouting technique that can penetrate fine grained soil mediums without causing soil fracturing.

Still another object of this invention is to provide a nontoxic grouting technique that uses a dilute suspension of cementatious particles capable of penetrating fine grained sands and silts.

Accordingly, a broad embodiment of this invention is directed at a method for grouting fine grained soil mediums, comprising in combination, the steps of:

(a) preparing a dilute suspension grout composition comprising cementatious particles and water admixed in a water to cementatious particles weight ratio of at least 4:1;

(b) injecting the grout composition into a soil medium at conditions such that the cementatious particles are removed from suspension and deposited in a cake layer on the soil medium; and (c) allowing the grout composition to set forming a solidified matrix of cementatious particles and soil medium thereby improving the stress of the soil medium.

DESCRIPTION OF PREFERRED EMBODIMENTS

Figure 1:
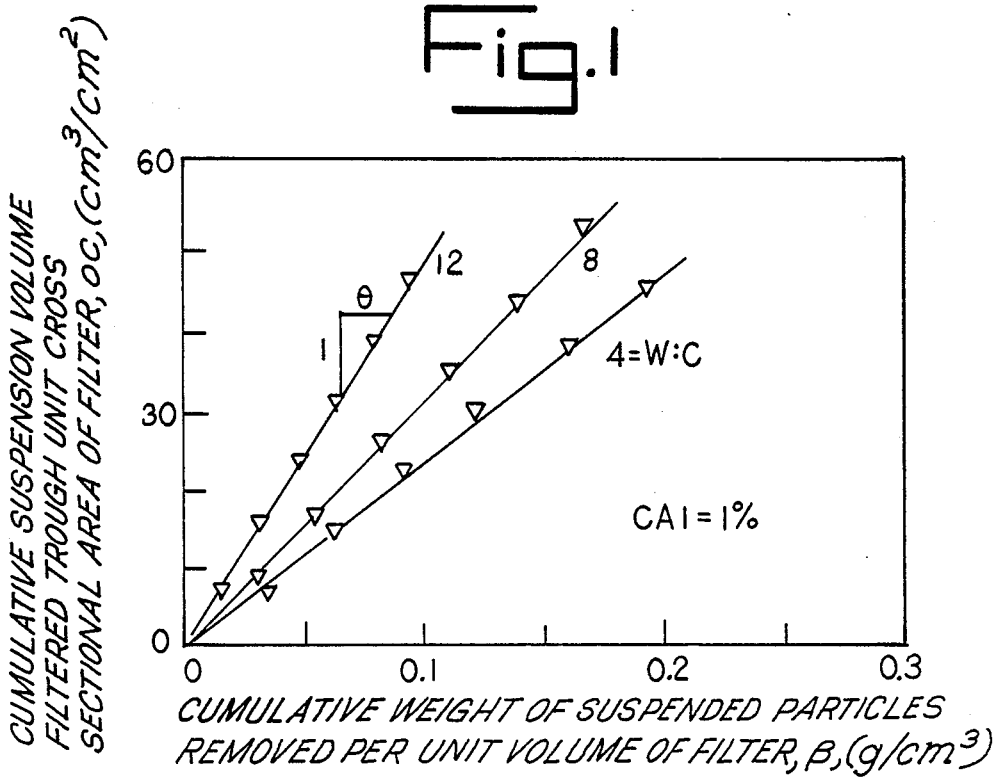
FIG. 1 is a graphical representation of test results showing the cumulative suspension volume filtered through unit cross sectional area of a filter medium plotted against the cumulative weight of suspended particles removed per unit volume of the filter medium when using a dilute suspension type grouting composition containing a dispersing agent.

Grouting of fine grained soil mediums using the suspension type grouting method of this invention can be considered as a process for filtration. During the process of filtration there is continuous interaction between the inflow suspension and the filter medium. A suspenion may contain solids which can be easily retained by a given granular medium but a high head loss may develop over a short distance in the filter medium; alternatively, head loss may develop over long distances in a filter medium which has a low suspended solid retention capacity. Accordingly, it is desirable to produce a good filtrate (high suspended solids removable) at a low head loss.

The depth of penetration of prior art suspension grouts can be improved by increasing the injection pressure or increasing the water:cement ratio. The injection of dilute microfine cement suspension in fine sands will behave as a filtration process. The instant invention is based on a mathematical relation that will allow a predication of particle removal throughout the depth of a soil medium. The mathematical relation is also based on the kind of injection technique employed and as a function of injected volume of the dilute suspension grout for given concentrations and discharge velocities.

As stated, removal of suspended particles from a dilute suspension cement grout flowing through a saturated fine sand maybe analyzed as a filtration process. Clarification of turbid water (removal of suspended matter using a sand filter) has been the main process considered in numerous studies of drinking water treatment. In developing a model one of the assumptions involved is that the filter medium consists of uniform spherical grains. Earlier observations of particle removal imply a random nature for the process of suspended particle removal. It has been found that suspended particle removal is higher in the areas where the hydraulic flow is lower. As time advances, the areas of a given cross section of the filter medium where the particle retention is high become filled by retained particles. As a result, the hydraulic radii increase, flow conditions improved, and flow viscosity increases. Increased local velocity can cause some of the deposits to be scoured back into the suspension. Continued filtration results in a more uniform distribution of the removal efficiently through the length of all flow channels. As more particles are retained, the hydraulic radius values and the available cross sectional areas for flow decrease and the efficiently of particles removal also decreaases. When the open cross sectional area is blocked by particles removed, filtration continues at a lower rate in the same manner as during a membrane refilteration test.

When a suspension is filtered through a porous medium the retention of suspended particles is affected by the size and concentration of the suspended particle and the pore sizes of the medium. At high concentrations of suspended particles, are arching affect develops which effectively blocks the voids in the porous medium and results in the formation of a "cake" near the surface of the porous medium. Subsequent filtration through this cake results in increased deposition of particles on the surface of the cake and substantial head loss through the cake. In normal grouting practice it is believed that this phenomenon develops at or near the injection point and results in both the blockage of the voids and in poor penetration of grout.

Another problem is encountered when fluvial deposits are grouted using grouting techniques of the prior art. Here grains of a cohesive soil matrix are covered by a film of fine soil particles. This film is formed during an initial period of deposition, and this may be followed by transportation of fine grains (silt and clay sizes) that are deposited in the granule matrix forming a film around the larger grains. The film of soil prevents cohesion of cement particles. This does not occur when the process of the instant invention is used. When diluted microfine cement suspensions with water to cement ratios of at least seven are injected under a pressure of about 10 psi through columns of fine grained sand the amount of suspended solids removed varies with depth. As the injection process continues the section with the maximum removal of suspended solids moves away from the injection face. Accordingly, for one section of a soil medium to achieve particle removal equal to that of another section which is closer to the injection face the injected suspension volume must increased. The smaller the hydraulic radius of the filter medium the greater the volume of removed suspended particles. During the injection of dilute suspenion type grout compositions particle removal results in two cementation modes. The first is crevice deposition and second is film formation. The cemented strength of a formation using the grouting technique of this invention is believed to be directly related to the formation of a film that envelops the grains of the soil medium being grouted. This film provides strength to the granule soil medium by cementation.

Although the depth of penetration of prior art cement grout compositions can be increased either by increasing the injection pressure or by injecting less concentrated grouts, there exist problems with each. Using concentrated (low water to cement ratio) suspensions and high injection pressure can lead to nonhomogeneous grouting of a soil formation due to the development of peripheral paths during the injection. Alternatively, hydraulic fracturing of the soil mass may occur due to high injection pressures. The method of the instant invention does not suffer these drawbacks and can be considered as a way to increase the depth of the penetration and improve grout distribution in fine grain soil masses.

During the injection process of this invention the deposition of particles is greater in zones where the passage of the suspension is more difficult or the hydraulic flow is lower or particulary nonexistent. The grains of the porous soil matrix are covered by microcement particles and calcium silicate hydrate gel. The resistance of this matrix is not significantly dependent on the water to cement ratio of the grout, but is dependent on the cake thickness and the hydration characteristics of the gel. The removal of particles from a dilute microfine cement suspension can be considered a deep bed filtration process that is random in nature and can be fitted by a CHI-Square probability distribution function. Further details of this probability function and the mathematical model predicting particle removal can be found in the following more detailed description.

The cementatious particles that may be used in this invention include Portland cement (all types), natural cement (all types, massonry cement (all types), gypsum, gypsum cement or plaster, Plaster of Paris, lime (slaked or unslaked), and Puzzolans, all materials which harden by a combination of hydrolysis and hydrations reactions upon the addition of water. Other materials that may be used as cementatious particles in this invention include asphaltic ligants, synthetic resins, inorganic resins, or hydrofuge colloids. The preferred cementing material is fine grained having particles less than 20 microns in size, preferably having a particle size in the range from about 1 micron to about 10 microns. Further, it is preferred that the particles of the cementatious material have a particle size greater than $\frac{1}{3}$ of the hydraulic radius of the particle size of the soil medium. A particularly preferred cementatious material is microfine cement. Two particular microfine cements are suitable for this invention, both are marketed by the Geochemical Corp. of New Jersey under the trade names MC-100 and MC-500. MC-100 is composed of a finely ground slag and contains a high content of $SiO_2$ and a low content of CaO relative to ordinary Portland cement. MC-500 is a finely ground mixture of slag and Portland cement and has a chemical composition intermediate between that of Portland and MC-100.

The dilute suspension grout composition of this invention may also contain a dispersing agent. A dispersing agent is defined as a surface-active agent added to a suspending medium to promote uniform and maximum separation of extremely fine solid particles. The use of a dispersing agent prevents flocculation of suspended cementatious particles. Flocculation causes the particles to agglomerate and decreases their ability to penetrate fine grained soil mediums. The use of a dispersing agent allows the dilute suspension grout composition to penetrate a soil medium to a greater depth.

Any dispersing agent suitable for use with aqueous solutions and known to the art may be used in this invention. Preferably the dispersing agent is a polymeric electrolyte that has been condensed from sodium silicates, polyphosphates, or lignin. A suitable dispersing agent is CAI marketed by Concrete Chemicals Company of Ohio. The preferred concentration of dispersing agent is from about 0.5 to 2.0 percent by weight of the cementatious particles, with a most preferred concentration of about 1.0 percent by weight. Addition of the dispersing agent to the dilute suspension grout composition may be made in any procedure known to the art. A preferred method involves adding the dispersing agent to water, mixing to insure a homogenous solution, followed by the addition of the cementatious particles.

The exact procedure of preparing the mixture of cementatious particles and water is not believed to be critical to this invention and may be performed using any procedure known to the art. The preferred ratio of water to cementatious particles is at least 4:1, most preferrably from about 4:1 to about 12:1. The dilute suspension grout composition can be mixed for a period of time from about 5 minutes to about 5 hours, with a preferred mixing time of about 15 minutes. The intensity of mixing is not believed to be critical within the first four hours of mixing, however, it is preferred to mix the admixture of cementatious particles and water at about 20 rpm.

Injection of a soil medium with the dilute suspension grout composition may be performed with any equipment known to the art. The preferred soil mediums to be injected are those characterized as coarse sands, medium sands, fine sands, and silt. These soil mediums have average grain diameters of less than 4.75 mm. Preferred soil mediums for grout injection with the dilute suspension grout composition of this invention are fine grained soil mediums having an average grain diameter in the range of from about 0.42 mm to about 0.074 mm. To ensure cementatious particle removal for the dilute suspension and adequate cake formation on the granules of the soil medium, it is preferred to inject the dilute suspension grout at a constant low pressure of from about 5 to about 30 psi, most preferably at a pressure of from about 10 to 20 psi.

In order to more fully demonstrate the attendant advantages arising from the present invention the following example is set forth. It is to be understood that the following is by way of example only and is not intended as an undue limitation on the broad scope of the invention.

EXAMPLE

Demonstration of the dilute suspension grouting method of this invention was carried out using laboratory scale equipment. The cementatious agent used was a microfine cement marketed by Onoda Cement Corporation of Japan under the trade name MC-500. The physical properties of this microcement are presented in Table 1 and the grain size distribution of the particles of the microfine cement were less than 15 microns. The soil medium used was a fine grained sand marketed by Material Service Corporation of Illinois under the trade name Crystal Silica. This fine sand was characterized by a grain size of between 0.640 to 0.150 mm. In tests where a dispersing agent was used, CAI, marketed by Concrete Chemicals of Ohio, was added to water prior to the addition of the and MC-500 at a level of 1 percent by weight of the cement.

Figure 2:
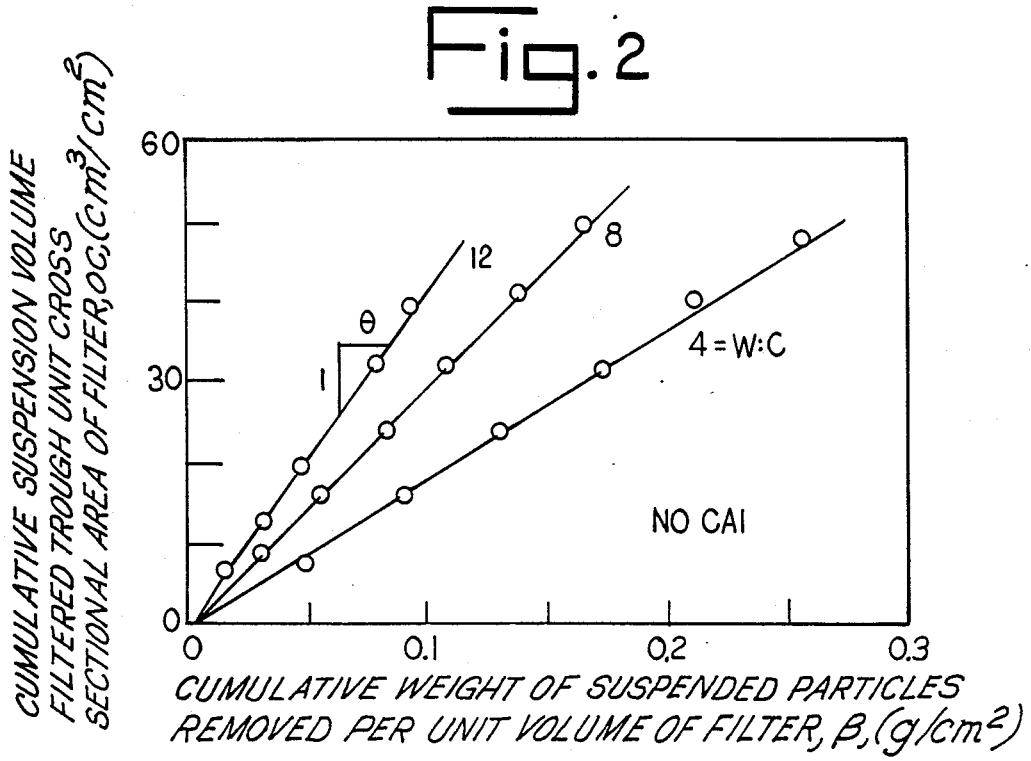
FIG. 2 is a graphical representation of test results showing the cumulative suspension volume filtered through unit cross sectional area of a filter medium plotted against cumulative weight of suspended particles removed through unit volume of a filter medium for a dilute suspension grout composition not containing a dispersing agent.

The grouting procedure involved preparing dilute suspensions of microfine cement with water to cement ratios of 4, 8, and 12. These suspensions were injected under a pressure of about 10 psi through columns of the fine sand. The sand was compacted to a porosity of about 0.44 in glass columns. Attempts to inject suspensions having water to cement ratios of about 2 were not successful. During each test, the volume of suspension injected was measured and the amounts of solids in the effluents were obtained. These measurements were used to compute the corresponding amounts of suspended solids retained by the fine sand medium or filter. The results of the tests provide a measure of the overall behavior and effectiveness of the grouting technique of this invention. These results are graphically presented in FIGS. 1 and 2 for suspensions prepared and grouted with and without dispersing agents. Each figure show the cummalative volume of suspenion filter per unit cross sectional area of the sand filter plotted against the cummulative weight of suspended particles removed per unit volume of the sand filter. The latter measurement indicates an average removal efficiently for the sand filter. A least squares estimate was used to fit the data points with straight lines passing through the origin of the coordinate system. It can be seen that the ratio of the total weight of particles removed to the total weight of particles injected, increases as the water to cement ratio increases. For equal amounts of dilute suspension filtered, use of a dispersing agent results in the retention of a smaller amount (weight) of cementatious particles. This is expected since the presence of the dispersing agent does not allow the cementatious particles to flocculate or form larger aggregates that can easily be captured in the matrix of the filter sand. However, the use of the dispersing agent allows the dilute suspension grout composition to penetrate the fine sand soil medium to a greater depth than would be possible without the use of a dispersing agent.

TABLE 1

| PHYSICAL PROPERTIES OF MC-500 | |
|---|---|
| Appearance | light-gray powder |
| Specific gravity | 3.00 ± 0.10 |
| Unit weight (Kg/l) | 1.00 ± 0.10 |
| odor | none |
| Fineness, Blain specific surface ($cm^2/g$) | about 8000 |
| Ignition loss (%) | 0.4 |
| $SiO_2$ (%) | 30.6 |
| $Al_2O_3$ (%) | 12.4 |

TABLE 1-continued

| PHYSICAL PROPERTIES OF MC-500 | |
|---|---|
| $Fe_2O_3$ (%) | 1.1 |
| CaO (%) | 48.4 |
| MgO (%) | 5.8 |
| $SO_3$ (%) | 0.8 |

I claim as my invention the following:

1. A method for grouting fine grained soil mediums, comprising in combination, the steps of:

(a) preparing a dilute suspension grout composition comprising fine grained cementatious particles and water admixed in a water to cementatious particles weight ratio of at least 4:1;

(b) injecting the grout composition into a soil medium at constant pressure such that the cementatious particles are removed from suspension and deposited in a cake layer on the soil medium; and (c) allowing the grout composition to set forming a solidified matrix of cementatious particles and soil medium thereby improving the stress of the soil medium.

2. The method of claim 1 where the soil medium comprises fine grains having an average grain diameter less than 4.75 mm.

3. The method of claim 1 where the injection of the dilute suspension grout composition is performed at a pressure of from about 10 to about 20 psi.

4. The method of claim 1 where the water to cementatious particles weight ratio is in the range from about 4 to about 12.

5. The method of claim 1 where the dilute suspension grout composition contains a polymeric electrolytic dispersing agent.

6. The method of claim 5 wherein the dispersing agent comprises 1% by weight of the cementatious particles.

7. The method of claim 5 where the dispersing agent is mixed with water prior to the admixing of the cementatious particles and water.

8. The method of claim 1 where the cementatious particles have an average particle size less than 10 microns.

9. The method of claim 1 where the cementatious particles are selected from the group consisting of Portland cement, massonry cement, gypsum, gypsum, gypsum cement, plastor, Plaster of Paris, lime, Puzzolans and mixtures thereof.

* * * * *